US009411297B1

(12) United States Patent
Kuroda et al.

(10) Patent No.: US 9,411,297 B1
(45) Date of Patent: Aug. 9, 2016

(54) IMAGE FORMATION APPARATUS HAVING GREATER DIFFERENTIAL VOLTAGE FOR LAST STATION IN A PRINT CONVEYANCE DIRECTION

(71) Applicant: Oki Data Corporation, Tokyo (JP)

(72) Inventors: Teruaki Kuroda, Tokyo (JP); Masahiro Kawano, Tokyo (JP); Yoshiaki Kusakabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/852,722

(22) Filed: Sep. 14, 2015

(30) Foreign Application Priority Data

Jan. 27, 2015 (JP) ..... 2015-013116

(51) Int. Cl.
*G03G 15/00* (2006.01)

(52) U.S. Cl.
CPC ..... *G03G 15/80* (2013.01)

(58) Field of Classification Search
CPC ..... G03G 15/01; G03G 15/06; G03G 15/065; G03G 15/095; G03G 15/08
See application file for complete search history.

(56) References Cited

U.S. PATENT DOCUMENTS

2004/0137349 A1* 7/2004 Horikoshi ..... G03G 9/0902 430/108.6
2004/0146312 A1* 7/2004 Saito ..... G03G 15/065 399/55
2009/0297188 A1* 12/2009 Yamamoto ..... G03G 15/065 399/49
2010/0303488 A1* 12/2010 Yanagi ..... G03G 15/065 399/45
2011/0097097 A1* 4/2011 Eom ..... G03G 15/065 399/55
2013/0195496 A1* 8/2013 Yamazawa ..... G03G 15/5004 399/88
2013/0230342 A1* 9/2013 Koido ..... G03G 15/0806 399/281

FOREIGN PATENT DOCUMENTS

JP 2014-032280 A 2/2014

* cited by examiner

*Primary Examiner* — Clayton E Laballe
*Assistant Examiner* — Ruifeng Pu
(74) *Attorney, Agent, or Firm* — Mots Law, PLLC

(57) ABSTRACT

An image formation apparatus includes development devices placed in stations and configured to sequentially start development in an order according to the arrangement order of the stations, and a power supply unit. Each development device includes a development unit, a supply unit to supply a developer to the development unit, and a regulation member to regulate an amount of the developer on the development unit. The power supply unit applies voltages to each regulation member and each supply unit such that a first development device has a greater differential voltage when the first development device is placed in a first station than when placed in a second station in which the development is started earlier than in the first station, where the differential voltage denotes a voltage obtained by subtracting the absolute value of the supply unit's voltage from the absolute value of the regulation member's voltage.

17 Claims, 13 Drawing Sheets

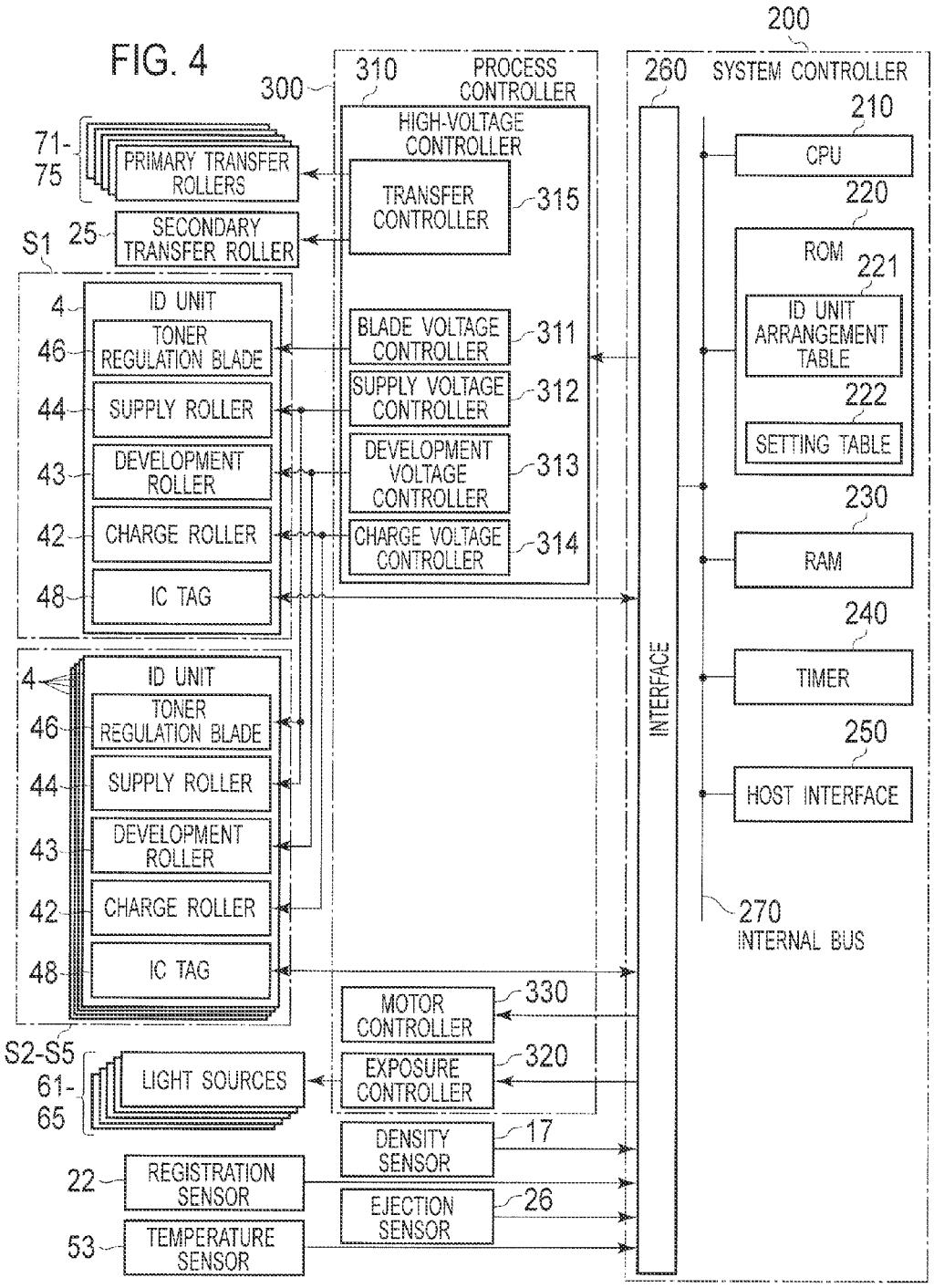
FIG. 4
200
SYSTEM CONTROLLER
260
INTERFACE
300
310
PROCESS CONTROLLER
HIGH-VOLTAGE CONTROLLER
TRANSFER CONTROLLER
315
BLADE VOLTAGE CONTROLLER
311
SUPPLY VOLTAGE CONTROLLER
312
DEVELOPMENT VOLTAGE CONTROLLER
313
CHARGE VOLTAGE CONTROLLER
314
MOTOR CONTROLLER
330
EXPOSURE CONTROLLER
320
71-75
PRIMARY TRANSFER ROLLERS
25
SECONDARY TRANSFER ROLLER
S1
4
ID UNIT
46
TONER REGULATION BLADE
44
SUPPLY ROLLER
43
DEVELOPMENT ROLLER
42
CHARGE ROLLER
48
IC TAG
S2-S5
61-65
LIGHT SOURCES
22
REGISTRATION SENSOR
53
TEMPERATURE SENSOR
DENSITY SENSOR
17
EJECTION SENSOR
26
210
CPU
220
ROM
221
ID UNIT ARRANGEMENT TABLE
222
SETTING TABLE
230
RAM
240
TIMER
250
HOST INTERFACE
270
INTERNAL BUS

FIG. 5A

| STATION | ID UNIT |
|---|---|
| S5 | 4K |
| S4 | 4Y |
| S3 | 4M |
| S2 | 4C |
| S1 | 4W |

FIG. 5B

| STATION | ID UNIT |
|---|---|
| S5 | 4W |
| S4 | 4Y |
| S3 | 4M |
| S2 | 4C |
| S1 | 4K |

FIG. 6A

| STATION | ID UNIT | BLADE VOLTAGE BB [V] | SUPPLY VOLTAGE SB [V] | ΔV (=\|BB\|-\|SB\|) | DEVELOPMENT VOLTAGE DB [V] | CHARGE VOLTAGE CH [V] |
|---|---|---|---|---|---|---|
| S5 | 4K | -285 | -285 | 0 | -205 | -1010 |
| S4 | 4Y | -300 | -300 | 0 | -200 | -1030 |
| S3 | 4M | -380 | -380 | 0 | -200 | -1060 |
| S2 | 4C | -300 | -300 | 0 | -170 | -1000 |
| S1 | 4W | -550 | -430 | 120 | -230 | -965 |

FIG. 6B

| STATION | ID UNIT | BLADE VOLTAGE BB [V] | SUPPLY VOLTAGE SB [V] | ΔV (=\|BB\|-\|SB\|) | DEVELOPMENT VOLTAGE DB [V] | CHARGE VOLTAGE CH [V] |
|---|---|---|---|---|---|---|
| S5 | 4W | -430 | -430 | 0 | -230 | -965 |
| S4 | 4Y | -300 | -300 | 0 | -200 | -1030 |
| S3 | 4M | -380 | -380 | 0 | -200 | -1060 |
| S2 | 4C | -300 | -300 | 0 | -170 | -1000 |
| S1 | 4K | -285 | -285 | 0 | -205 | -1010 |

FIG. 11

| BLADE VOLTAGE BB [V] | SUPPLY VOLTAGE SB [V] | GRAY BACKGROUND LEVEL | STAIN LEVEL | WHITE DENSITY |
|---|---|---|---|---|
| -430 | -430 | 9 | 9 | 0.35 |

FIG. 13

| BLADE VOLTAGE BB [V] | SUPPLY VOLTAGE SB [V] | GRAY BACKGROUND LEVEL | STAIN LEVEL | WHITE DENSITY |
|---|---|---|---|---|
| -430 | -430 | 5 | 9 | 0.25 |

| BLADE VOLTAGE BB [V] | SUPPLY VOLTAGE SB [V] | GRAY BACKGROUND LEVELL | STAIN LEVEL | WHITE DENSITY |
|---|---|---|---|---|
| -550 | -550 | 9 | 5 | 0.25 |

| BLADE VOLTAGE BB [V] | SUPPLY VOLTAGE SB [V] | GRAY BACKGROUND LEVEL | STAIN LEVEL | WHITE DENSITY |
|---|---|---|---|---|
| -550 | -430 | 9 | 9 | 0.25 |

IMAGE FORMATION APPARATUS HAVING GREATER DIFFERENTIAL VOLTAGE FOR LAST STATION IN A PRINT CONVEYANCE DIRECTION

CROSS REFERENCE TO RELATED APPLICATIONS

This application claims priority based on 35 USC 119 from prior Japanese Patent Application No. 2015-013116 filed on Jan. 27, 2015, entitled "IMAGE FORMATION APPARATUS", the entire contents of which are incorporated herein by reference.

BACKGROUND OF THE INVENTION

1. Field of the Invention

This disclosure relates to an image formation apparatus for forming an image.

2. Description of Related Art

Some image formation apparatuses have plural development devices and are configured to be capable of printing a color image (for example, Japanese Patent Application Publication No. 2014-32280). In such an image formation apparatus, each development device includes, for example, a supply roller, a development roller, a blade, and a photoreceptor drum. In each development device, for example, the supply roller supplies toner to the development roller, and the blade spreads the toner into a uniform toner layer on the surface of the development roller. Consequently, each development device develops a toner image on a surface of the photoreceptor drum on which an electrostatic latent image is formed.

SUMMARY OF THE INVENTION

An object of an embodiment of the invention is to provide an image formation apparatus capable of improving image quality.

An aspect of the invention is an image formation apparatus that includes: development devices placed on a one-to-one basis in stations arranged side by side, and configured to sequentially start the development in an order according to an arrangement order of the stations; and a power supply unit. Each development device includes a development unit, a supply unit configured to supply a developer to the development unit, and a regulation member configured to regulate an amount of the developer adhering on the development unit. The power supply unit applies voltages to each regulation member and each supply unit such that a first development device among the development devices has a greater differential voltage when the first development device is placed in a first station than when the first development device is placed in a second station in which the development is started earlier than in the first station, where the differential voltage denotes a voltage obtained by subtracting the absolute value of a voltage of the supply unit from the absolute value of a voltage of the regulation member.

According to an aspect of the invention, the first development device is set to have a greater differential voltage when being placed in the first station than when the first development device is placed in the second station, and thus, image quality can be improved.

BRIEF DESCRIPTION OF THE DRAWINGS

FIG. 4 is a block diagram illustrating one example of a configuration of the image formation apparatus illustrated in FIG. 1.

FIG. 5A is a table illustrating one example of an ID unit arrangement table illustrated in FIG. 4.

FIG. 5B is a table illustrating another example of the ID unit arrangement table illustrated in FIG. 4.

FIG. 6A is a table illustrating one example of a setting table illustrated in FIG. 4.

FIG. 6B is a table illustrating another example of the setting table illustrated in FIG. 4.

FIG. 11 is a table illustrating one example of characteristics of the image formation apparatus illustrated in FIG. 1.

FIG. 13 is a table illustrating another example of characteristics of the image formation apparatus illustrated in FIG. 1.

DETAILED DESCRIPTION OF EMBODIMENTS

Figure 1:
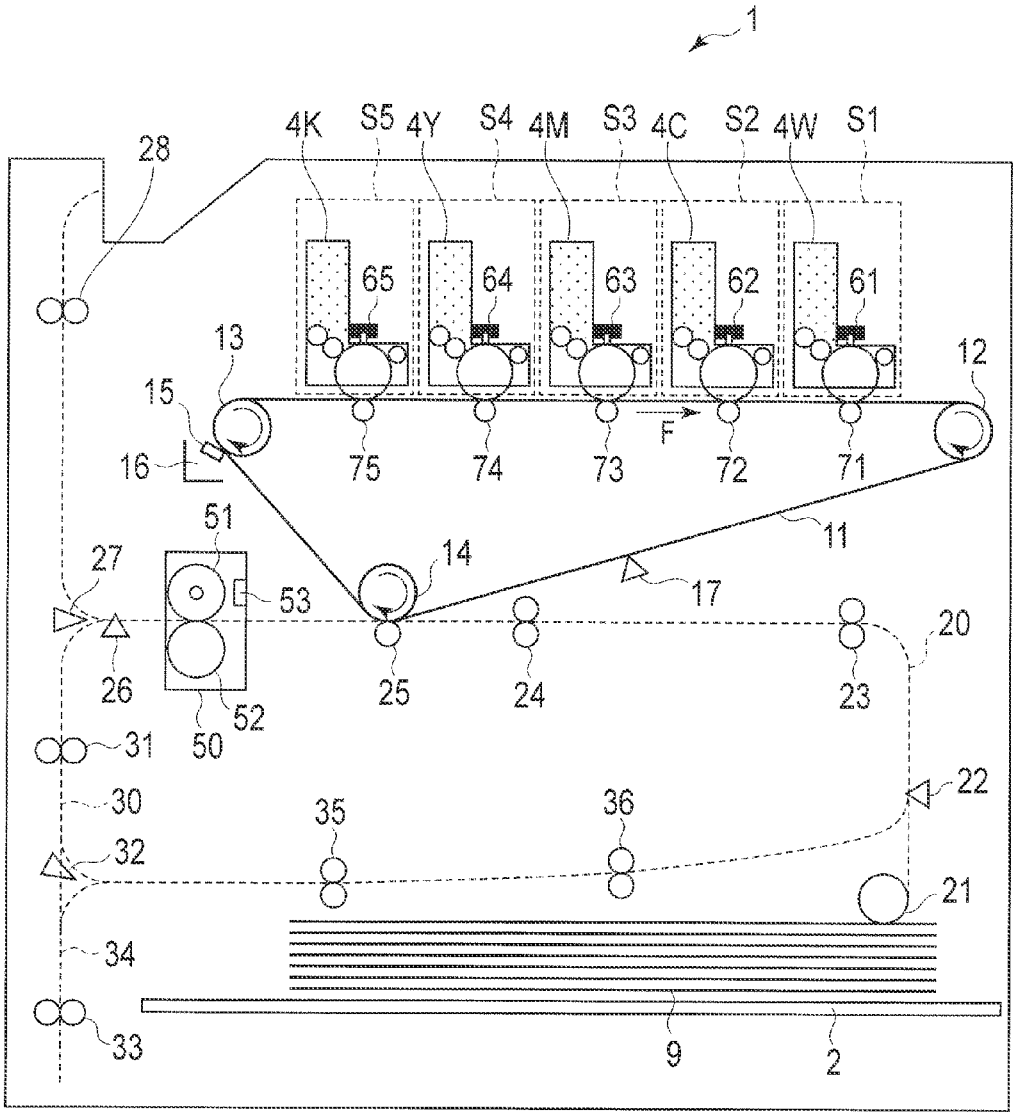
FIG. 1 is an explanatory diagram illustrating one example of a configuration of an image formation apparatus according to one embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

An embodiment of the invention is described in detail below with reference to the drawings.

(Example of Configuration)

FIG. 1 illustrates one example of a configuration of an image formation apparatus (image formation apparatus 1) according to one embodiment of the invention. Image formation apparatus 1 functions as a printer to form an image on a recording medium, such as for example paper, using electrophotography.

Image formation apparatus 1 includes five image drum (ID) units 4 (4K, 4Y, 4M, 4C, 4W), light sources 61 to 65, primary transfer rollers 71 to 75, intermediate transfer belt 11, drive roller 12, belt follower roller 13, secondary transfer back-up roller 14, cleaning blade 15, and density sensor 17.

ID units 4 are each operative to form a toner image. ID units 4 are placed in five stations S1 to S5, respectively, on a one-to-one basis. In this example, five stations S1 to S5 are disposed in the order of stations S5, S4, S3, S2, S1 in conveyance direction F. In this example, then, ID unit 4K to form a toner image of a black color (K) is placed in station S5, ID unit 4Y to form a toner image of a yellow color (Y) is placed in station S4, ID unit 4M to form a toner image of a magenta color (M) is placed in station S3, ID unit 4C to form a toner image of a cyan color (C) is placed in station S2, and ID unit 4W to form a toner image of a white color (W) is placed in station S1. Each ID unit 4 is configured to be attachable to, and detachable from, any of the five stations S1 to S5. Thus, image formation apparatus 1 is adapted to be capable of changing the order of ID units 4 (or the order of the colors) in five stations S1 to S5, for example, as described later.

Figure 2:
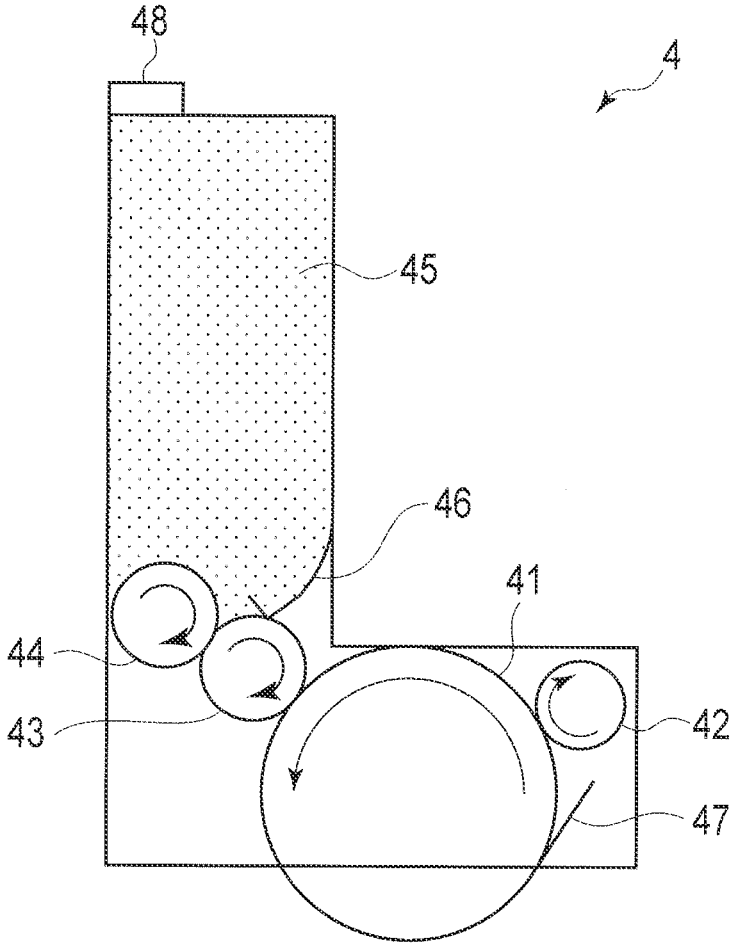
FIG. 2 is an explanatory diagram illustrating one example of a configuration of the ID unit illustrated in FIG. 1.

FIG. 2 illustrates one example of a configuration of ID unit 4. ID unit 4 includes photoreceptor drum 41, charge roller 42, development roller 43, supply roller 44, toner container 45, toner regulation blade 46, cleaning blade 47, and integrated circuit (IC) tag 48.

Photoreceptor drum 41 is a member to carry an electrostatic latent image on its surface (or surface layer portion), and is constructed using a photoreceptor. Photoreceptor drum 41 rotates in a left-handed direction in this example, by power transmitted from a photoreceptor drum motor (not illustrated). Photoreceptor drum 41 is charged by charge roller 42. Then, photoreceptor drum 41 of ID unit 4 placed in station S1 is exposed to light by light source 61, photoreceptor drum 41 of ID unit 4 placed in station S2 is exposed to light by light source 62, photoreceptor drum 41 of ID unit 4 placed in station S3 is exposed to light by light source 63, photoreceptor drum 41 of ID unit 4 placed in station S4 is exposed to light by light source 64, and photoreceptor drum 41 of ID unit 4 placed in station S5 is exposed to light by light source 65. Thus, an electrostatic latent image is formed on the surface of each photoreceptor drum 41.

Charge roller 42 is a member to charge the surface (or the surface layer portion) of photoreceptor drum 41. Charge roller 42 is arranged so as to contact the surface (or a peripheral surface) of photoreceptor drum 41, and rotates in a right-handed direction in this example, in response to the rotation of photoreceptor drum 41. Charge voltage CH is applied to charge roller 42 by charge voltage controller 314, as described later.

Development roller 43 is a member to carry toner on its surface. Development roller 43 is arranged so as to contact the surface (or the peripheral surface) of photoreceptor drum 41, and is adapted to rotate in the right-handed direction in this example, by the photoreceptor drum motor and a gear (not illustrated). In ID unit 4, in this rotation, a gear ratio is set so as to produce friction between the surface of development roller 43 and the surface of photoreceptor drum 41. On each photoreceptor drum 41, a toner image is formed (or developed) according to the electrostatic latent image, by the toner supplied from development roller 43. Development voltage DB is applied to development roller 43 by development voltage controller 313, as described later.

Supply roller 44 is a member to supply the toner stored in toner container 45 to development roller 43. Supply roller 44 is arranged so as to contact the surface (or a peripheral surface) of development roller 43, and is adapted to rotate in the right-handed direction in this example, by the photoreceptor drum motor and the gear (not illustrated). Thus, in ID unit 4, friction develops between the surface of supply roller 44 and the surface of development roller 43, so that the toner, in turn, is charged by what is called frictional electrification. Supply voltage SB is applied to supply roller 44 by supply voltage controller 312, as described later.

Toner container 45 is operative to store the toner. Specifically, toner container 45 in ID unit 4K stores the toner of the black color (K), toner container 45 in ID unit 4Y stores the toner of the yellow color (Y), toner container 45 in ID unit 4M stores the toner of the magenta color (M), toner container 45 in ID unit 4C stores the toner of the cyan color (C), and toner container 45 in ID unit 4W stores the toner of the white color (W). The black toner contains carbon black for example, as a colorant. The yellow toner contains pigment yellow for example, as a colorant. The magenta toner contains pigment magenta for example, as a colorant. The cyan toner contains pigment cyan for example, as a colorant. The white toner contains titanium oxide for example, as a colorant. In this example, electrical conductivity of the white toner is higher than the electrical conductivity of the toner of the other colors.

Toner regulation blade 46 is a member configured to abut the surface of development roller 43 and thereby to form a layer made of the toner (or a toner layer) on the surface of development roller 43 and also regulate (or control or adjust) a thickness of the toner layer. Toner regulation blade 46 also has a function of adjusting the amount of electrostatic charge on the toner on the surface of development roller 43. Toner regulation blade 46 is, for example, a plate-shaped elastic member (e.g. a leaf spring) made of stainless steel or the like, and is arranged in such a manner that a tip end portion of toner regulation blade 46 abuts on the surface of development roller 43. As described later, supply voltage SB is applied by supply voltage controller 312 to toner regulation blades 46 of ID units 4 placed in stations S2 to S5, and blade voltage BB is applied by blade voltage controller 311 to toner regulation blade 46 of ID unit 4 placed in station S1.

Cleaning blade 47 is a member to perform cleaning by scraping the toner remaining on the surface (or the surface layer portion) of photoreceptor drum 41. Cleaning blade 47 is arranged so as to abut the surface of photoreceptor drum 41, counter thereto (or protruding in the opposite direction to a direction of rotation of photoreceptor drum 41).

IC tag 48 is a tag to store data on an identification number of ID unit 4, the color of the toner in toner container 45, or the like. What is called RFID (Radio Frequency IDentifier), for example, can be used as IC tag 48. The data stored in IC tag 48 is read for example by wire communication or radio communication, for example via interface 260 to be described later.

Light source 61 (see FIG. 1) is a member to apply light to photoreceptor drum 41 of ID unit 4 placed in station S1, light source 62 is a member to apply light to photoreceptor drum 41 of ID unit 4 placed in station S2, light source 63 is a member to apply light to photoreceptor drum 41 of ID unit 4 placed in station S3, light source 64 is a member to apply light to photoreceptor drum 41 of ID unit 4 placed in station S4, and light source 65 is a member to apply light to photoreceptor drum 41 of ID unit 4 placed in station S5. Thus, photoreceptor drums 41 are exposed to light by light sources 61 to 65, respectively. Consequently, the electrostatic latent image is formed on the surface of each photoreceptor drum 41.

Primary transfer rollers 71 to 75 are members to electrostatically transfer the toner images formed by five ID units 4 placed in stations S1 to S5, respectively, on a transfer surface of intermediate transfer belt 11. Primary transfer roller 71 is arranged facing photoreceptor drum 41 of ID unit 4 placed in station S1, with intermediate transfer belt 11 in between. Likewise, primary transfer roller 72 is arranged facing photoreceptor drum 41 of ID unit 4 placed in station S2, with intermediate transfer belt 11 in between, primary transfer roller 73 is arranged facing photoreceptor drum 41 of ID unit 4 placed in station S3, with intermediate transfer belt 11 in between, primary transfer roller 74 is arranged facing photoreceptor drum 41 of ID unit 4 placed in station S4, with intermediate transfer belt 11 in between, and primary transfer roller 75 is arranged facing photoreceptor drum 41 of ID unit 4 placed in station S5, with intermediate transfer belt 11 in between. Transfer voltage TR1 is applied to each of primary transfer rollers 71 to 75 by transfer controller 315, as described later. Thus, in image formation apparatus 1, the toner image formed by each ID unit 4 is transferred (or primarily transferred) on the transfer surface of intermediate transfer belt 11.

Intermediate transfer belt 11 is, for example, an endless elastic belt constructed of a semiconducting plastic film of high resistance. Intermediate transfer belt 11 is stretched in tension by drive roller 12, belt follower roller 13, and secondary transfer back-up roller 14. Then, intermediate transfer belt 11 is adapted to cyclically rotate in conveyance direction F in response to the rotation of drive roller 12. In this rotation, intermediate transfer belt 11 is adapted to move between ID unit 4 placed in station S5 and primary transfer roller 75, between ID unit 4 placed in station S4 and primary transfer roller 74, between ID unit 4 placed in station S3 and primary transfer roller 73, between ID unit 4 placed in station S2 and primary transfer roller 72, and between ID unit 4 placed in station S1 and primary transfer roller 71.

Drive roller 12 is operative to cyclically rotate intermediate transfer belt 11. In this example, drive roller 12 is arranged on the downstream side of five ID units 4 in conveyance direction F, and rotates in the right-handed direction in this example, by power transmitted from a belt drive motor (not illustrated). Thus, drive roller 12 is adapted to cyclically rotate intermediate transfer belt 11 in conveyance direction F.

Belt follower roller 13 makes the follower roller rotation in the right-handed direction in this example, in response to the cyclic rotation of intermediate transfer belt 11. In this example, belt follower roller 13 is arranged on the upstream side of the five ID units 4 in conveyance direction F.

Secondary transfer back-up roller 14 makes the follower roller rotation in the right-handed direction in this example, in response to the cyclic rotation of intermediate transfer belt 11. Secondary transfer back-up roller 14 is arranged facing secondary transfer roller 25 (to be described later), with conveyance path 20 for the conveyance of recording medium 9 and with the intermediate transfer belt 11 in between, as described later.

Cleaning blade 15 is a member to perform cleaning by scraping a deposit, such as the toner, adhering on the transfer surface of intermediate transfer belt 11. In this example, cleaning blade 15 is arranged so as to abut the transfer surface of intermediate transfer belt 11 at a position facing belt follower roller 13. The deposit scraped off by cleaning blade 15 is accommodated in container 16.

Density sensor 17 is operative to detect the density of the toner of each color on the transfer surface of intermediate transfer belt 11. Density sensor 17 is used for density correction, for example at power-on or the like, as described later.

Image formation apparatus 1 further includes hopping roller 21, registration sensor 22, registration roller 23, conveyance roller 24, secondary transfer roller 25, fixation device 50, ejection sensor 26, separator 27, and ejection roller 28. These members are arranged along conveyance path 20 for the conveyance of recording medium 9.

Hopping roller 21 is a member to take out recording media 9 contained in paper feed tray 2, one by one, starting at the topmost one, and to send out taken-out recording medium 9 to conveyance path 20. Registration sensor 22 is a mechanical sensor to detect the passage of recording medium 9. Registration roller 23 is constructed of a pair of rollers with conveyance path 20 in between, and is operative to correct an oblique position of recording medium 9 fed from hopping roller 21. Conveyance roller 24 is constructed of a pair of rollers with conveyance path 20 in between, and is operative to convey recording medium 9 so that recording medium 9 reaches a nip portion between secondary transfer back-up roller 14 and secondary transfer roller 25 at an appropriate time.

Secondary transfer roller 25 is a member to transfer a toner image on the transfer surface of intermediate transfer belt 11, onto a transfer surface of recording medium 9. Secondary transfer roller 25 is arranged facing secondary transfer back-up roller 14, with intermediate transfer belt 11 and conveyance path 20 in between. Transfer voltage TR2 is applied to secondary transfer roller 25 by transfer controller 315, as described later. Thus, in image formation apparatus 1, the toner image on the transfer surface of intermediate transfer belt 11 is transferred (or secondarily transferred) on the transfer surface of recording medium 9.

Fixation device 50 is a member to fix the toner image transferred on recording medium 9, to recording medium 9, by applying heat and pressure to recording medium 9. Fixation device 50 includes heat roller 51, press roller 52, and temperature sensor 53. Heat roller 51 is, for example, a member internally including a heater such as a halogen lamp, and configured to apply heat to the toner on recording medium 9. Press roller 52 is a member arranged in such a way as to form a pressure contact portion between press roller 52 and heat roller 51, and configured to apply pressure to the toner on recording medium 9. Temperature sensor 53 is operative to detect a surface temperature of heat roller 51 or press roller 52. Thus, in fixation device 50, the toner on recording medium 9 is heated and thus fused and is pressed. Consequently, the toner image is fixed on recording medium 9.

Ejection sensor 26 is a mechanical sensor to detect passage of recording medium 9. Separator 27 is operative to perform a control to determine whether to guide recording medium 9 to a conveyance path for ejection of recording medium 9 out of image formation apparatus 1 or to guide recording medium 9 to re-conveyance path 30 (to be described later). Ejection roller 28 is a member to eject recording medium 9 out of image formation apparatus 1, when separator 27 guides recording medium 9 to the conveyance path for an ejection of recording medium 9 out of image formation apparatus 1.

Image formation apparatus 1 further includes re-conveyance roller 31, separator 32, and re-conveyance rollers 33, 35, 36. These members are arranged along re-conveyance path 30. Re-conveyance path 30 is used, for example, to retransfer a toner image to the surface of recording medium 9 on which a toner image has been fixed once, or to transfer a toner image to a surface opposite from the surface having a toner image fixed thereon (i.e. to perform what is called two-sided printing).

Re-conveyance roller 31 is a member to convey recording medium 9 along re-conveyance path 30, when separator 27 guides recording medium 9 to re-conveyance path 30. Separator 32 is operative to perform a control to determine whether to guide recording medium 9 as it is to re-conveyance path 30 or to turn recording medium 9 over and then guide recording medium 9 to re-conveyance path 30. Re-conveyance roller 33 is a member provided in conveyance path 34 to turn recording medium 9 over. Re-conveyance roller 33 and conveyance path 34 are used for what is called two-sided printing. Re-conveyance roller 35 is a member to convey recording medium 9 guided by separator 32, along re-conveyance path 30. Re-conveyance roller 36 is a member to guide recording medium 9 conveyed by re-conveyance roller 35, again to conveyance path 20.

By this configuration, in image formation apparatus 1, the toner image formed by each ID unit 4 is transferred (or primarily transferred) on the transfer surface of intermediate transfer belt 11, and the toner image on the transfer surface of intermediate transfer belt 11 is transferred (or secondarily transferred) on the transfer surface of recording medium 9. When so doing, image formation apparatus 1 can change the order of ID units 4 (or the order of the colors) in five stations S1 to S5, as described below.

Figure 3A:
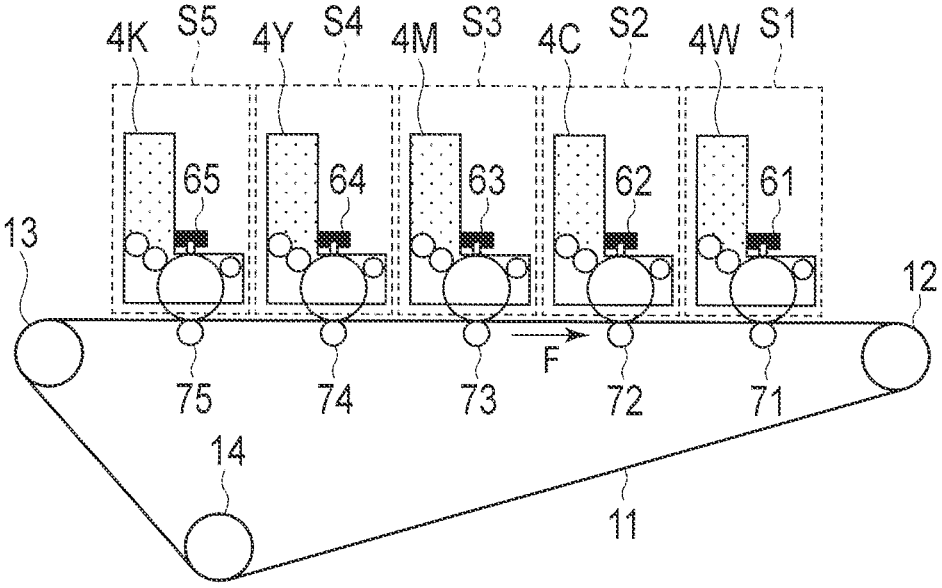
FIG. 3A is an explanatory diagram illustrating an example of the arrangement of the ID units.
Figure 3B:
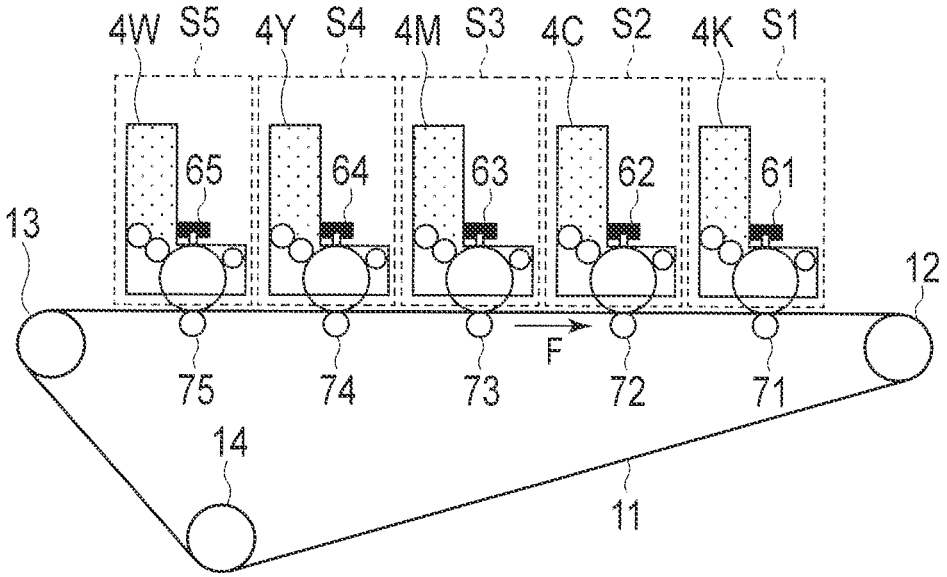
FIG. 3B is an explanatory diagram illustrating another example of the arrangement of the ID units.

FIGS. 3A and 3B illustrate examples of an arrangement of ID units 4 in five stations S1 to S5; FIG. 3A illustrates the example in which ID units 4K, 4Y, 4M, 4C, 4W are placed in this order in five stations S5, S4, S3, S2, S1, respectively, as is the case with FIG. 1. FIG. 3B illustrates the example in which ID units 4W, 4Y, 4M, 4C, 4K are placed in this order in five stations S5, S4, S3, S2, S1, respectively.

Image formation apparatus 1 allows a user to change the order of ID units 4 (or the order of the colors) in five stations S1 to S5, for example according to the type of recording medium 9. For example, when recording medium 9 is paper, ID units 4K, 4Y, 4M, 4C, 4W can be placed in this order in five stations S5, S4, S3, S2, S1, respectively, as illustrated in FIG. 3A. In other words, when ID units 4 are placed in this manner, a toner image of the black color (K), a toner image of the yellow color (Y), a toner image of the magenta color (M), a toner image of the cyan color (C) and a toner image of the white color (W) are sequentially transferred in this order on the transfer surface of intermediate transfer belt 11. In other words, the toner image of the white color (W) is transferred as the uppermost layer on the transfer surface of intermediate transfer belt 11. In a subsequent secondary transfer, therefore, the toner image of the white color (W) is transferred as the lowest layer on a paper sheet (i.e. recording medium 9). This, for example when the color of paper (i.e. recording medium 9) is not white, enables reducing the likelihood of the color of the paper affecting image quality, thus improving the image quality.

Moreover, for example, when recording medium 9 is a transparent film, ID units 4W, 4Y, 4M, 4C, 4K can be placed in this order in five stations S5, S4, S3, S2, S1, respectively, as illustrated in FIG. 3B. In other words, when ID units 4 are placed in this manner, a toner image of the white color (W), a toner image of the yellow color (Y), a toner image of the magenta color (M), a toner image of the cyan color (C) and a toner image of the black color (K) are sequentially transferred in this order on the transfer surface of intermediate transfer belt 11. In other words, the toner image of the white color (W) is transferred as the lowermost layer on the transfer surface of intermediate transfer belt 11. In a subsequent secondary transfer, therefore, the toner image of the white color (W) is transferred as the uppermost layer on the transparent film (i.e. recording medium 9). This enables improving image quality, for example when the user observes a printed image from the surface of the transparent film (i.e. recording medium 9) opposite from the transfer surface thereof.

Note that, in this instance, the arrangement of ID units 4 is described by two examples (i.e. FIGS. 3A and 3B) given, but the invention is not so limited, and various arrangements are possible.

FIG. 4 illustrates one example of a control unit in image formation apparatus 1. Image formation apparatus 1 includes system controller 200 and process controller 300.

System controller 200 is operative to control the overall operation of image formation apparatus 1. System controller 200 includes central processing unit (CPU) 210, read only memory (ROM) 220, random access memory (RAM) 230, timer 240, host interface 250, and interface 260. These components are interconnected via internal bus 270.

CPU 210 is operative to control the overall operation of image formation apparatus 1 according to a printing processing program stored in ROM 220, based on print data fed, for example, from a personal computer (not illustrated) via host interface 250. Specifically, CPU 210 is adapted to control RAM 230 and timer 240 according to the printing processing program and also control operation of the members in image formation apparatus 1 via interface 260.

ROM 220 is a nonvolatile memory and is operative to store the printing processing program. ROM 220 also stores ID unit arrangement table 221 and setting table 222.

ID unit arrangement table 221 indicates the arrangement of ID units 4 in five stations S1 to S5.

FIGS. 5A and 5B illustrate examples of ID unit arrangement table 221. FIG. 5A illustrates the example in a case where ID units 4K, 4Y, 4M, 4C, 4W are placed in this order in five stations S5, S4, S3, S2, S1, respectively, as illustrated in FIG. 3A. FIG. 5B illustrates the example in a case where ID units 4W, 4Y, 4M, 4C, 4K are placed in this order in five stations S5, S4, S3, S2, S1, respectively, as illustrated in FIG. 3B. ID unit arrangement table 221 indicates the correspondence between five stations S1 to S5 and five ID units 4 (4K, 4Y, 4M, 4C, 4W). In the example of FIG. 5A, stations S5, S4, S3, S2, S1 are associated with ID units 4K, 4Y, 4M, 4C, 4W, respectively, and in the example of FIG. 5B, stations S5, S4, S3, S2, S1 are associated with ID units 4W, 4Y, 4M, 4C, 4K, respectively.

Setting table 222 contains various parameters to cause image formation apparatus 1 to operate.

FIGS. 6A and 6B illustrate information on four parameters (i.e. blade voltage BB, supply voltage SB, development voltage DB, and charge voltage CH) in setting table 222. FIG. 6A illustrates an example in a case where ID units 4K, 4Y, 4M, 4C, 4W are placed in this order in five stations S5, S4, S3, S2, S1, respectively, as illustrated in FIG. 3A. FIG. 6B illustrates an example in a case where ID units 4W, 4Y, 4M, 4C, 4K are placed in this order in five stations S5, S4, S3, S2, S1, respectively, as illustrated in FIG. 3B. Note that FIGS. 6A and 6B also illustrate differential voltage $\Delta V$ ($=|BB|-|SB|$) between an absolute value of blade voltage BB and an absolute value of supply voltage SB, for convenience of explanation.

As illustrated in FIGS. 6A and 6B, blade voltage BB, supply voltage SB, development voltage DB, and charge voltage CH are set for each of the five ID units 4. Moreover, for example, a voltage to be set for ID unit 4 associated with a toner of a certain color can be set so as to vary according to the station in which ID unit 4 is placed. Specifically, in this example, blade voltage BB and supply voltage SB for ID unit 4W, when ID unit 4W is placed in station S1 (FIG. 6A), are set to their respective values which are different from those when ID unit 4W is placed in station S5 (FIG. 6B). More specifically, for example, differential voltage $\Delta V$ for ID unit 4W has a positive value (120 V) when ID unit 4W is placed in station S1 (FIG. 6A), whereas differential voltage $\Delta V$ is 0 V when ID unit 4W is placed in station S5 (FIG. 6B). Thus, image formation apparatus 1 is adapted to set blade voltage BB, supply voltage SB, development voltage DB and charge voltage CH to be applied to each ID unit 4, based on the arrangement of ID units 4 in the five stations S1 to S5.

RAM 230 is a volatile memory to function as what is called a working memory. Specifically, RAM 230 is adapted to store print data, various types of control timing measured by timer 240, or the like, for example.

Timer 240 is operative to measure time and feed the measured time to CPU 210.

Host interface 250 is operative to receive print data from the personal computer (not illustrated) and also communicate various control signals to and from the personal computer.

Interface 260 is an interface to allow system controller 200 to control the operation of the members of image formation apparatus 1. Specifically, system controller 200 feeds control signals to high-voltage controller 310 (to be described later), exposure controller 320 and motor controller 330 of process controller 300 via interface 260, and also receives detected results from density sensor 17, registration sensor 22, ejection sensor 26 and temperature sensor 53 via interface 260. System controller 200 is also operative to communicate information to and from IC tag 48 of each ID unit 4 via interface 260.

Process controller 300 is operative to control a printing process such as the conveyance of recording medium 9, charging, development, transfer, or fixing. Process controller 300 includes high-voltage controller 310, exposure controller 320, and motor controller 330.

High-voltage controller 310 is operative to apply voltages to each ID unit 4, primary transfer rollers 71 to 75, and secondary transfer roller 25, respectively. High-voltage controller 310 includes blade voltage controller 311, supply voltage controller 312, development voltage controller 313, charge voltage controller 314, and transfer controller 315.

Blade voltage controller 311 is operative to apply blade voltage BB to toner regulation blade 46 of ID unit 4 placed in station S1.

Supply voltage controller 312 is operative to apply supply voltage SB to toner regulation blades 46 and supply rollers 44 of ID units 4 placed in stations S2 to S5, and to apply supply voltage SB to supply roller 44 of ID unit 4 placed in station S1.

Figure 7:
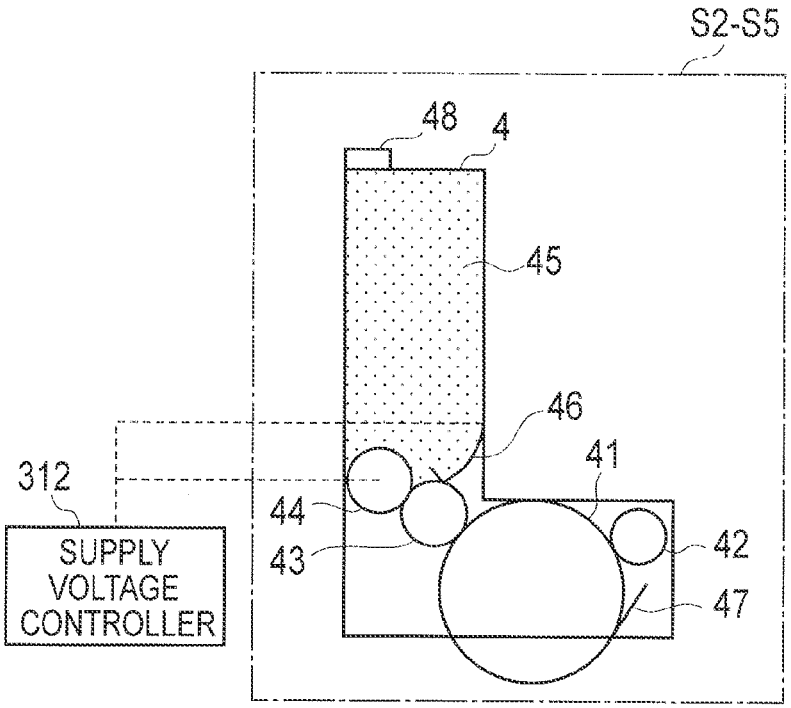
FIG. 7 is an explanatory diagram illustrating an example of a supply of voltage to the ID unit illustrated in FIG. 2.
Figure 8:
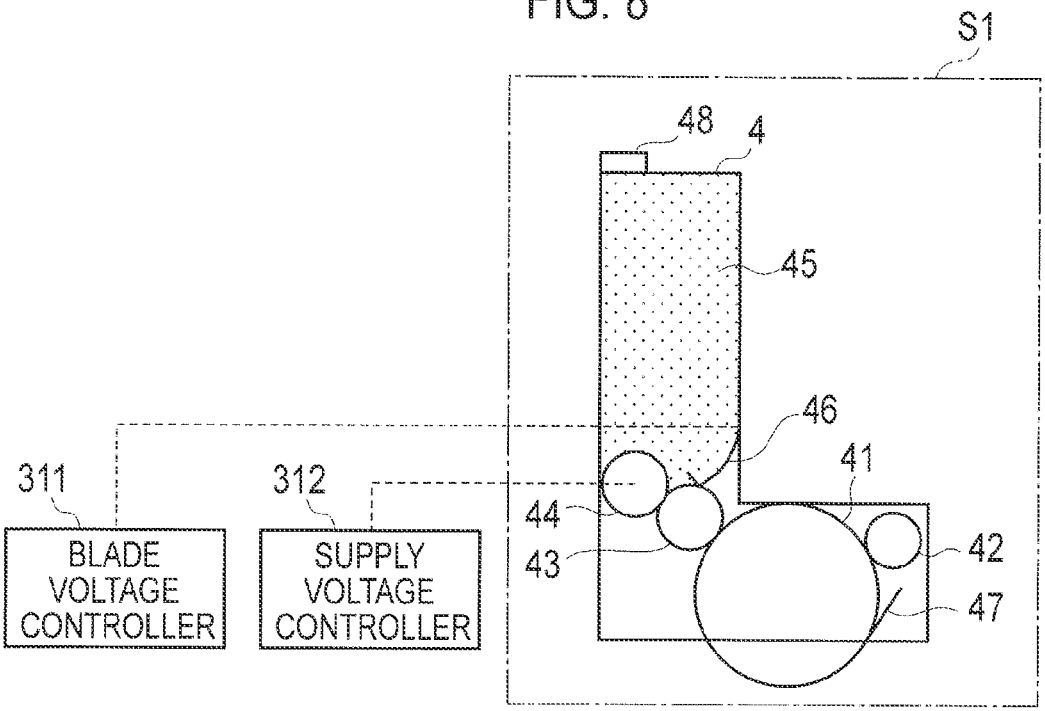
FIG. 8 is an explanatory diagram illustrating another example of a supply of voltage to the ID unit illustrated in FIG. 2.

FIGS. 7 and 8 illustrate an application of voltage to toner regulation blades 46 and supply rollers 44 in ID units 4. FIG. 7 illustrates an example of ID units 4 placed in stations S2 to S5, and FIG. 8 illustrates an example of ID unit 4 placed in station S1. In ID units 4 placed in stations S2 to S5, supply voltage controller 312 applies the same voltage (i.e. supply voltage SB) to toner regulation blades 46 and supply rollers 44, as illustrated in FIG. 7. In other words, in each of ID units 4 placed in stations S2 to S5, blade voltage BB of toner regulation blade 46 becomes equal to supply voltage SB of supply roller 44. Meanwhile, in ID unit 4 placed in station S1, as illustrated in FIG. 8, blade voltage controller 311 applies blade voltage BB to toner regulation blade 46, and supply voltage controller 312 applies supply voltage SB to supply roller 44. Thus, in ID unit 4 placed in station S1, blade voltage BB of toner regulation blade 46 and supply voltage SB of supply roller 44 can be individually set.

Development voltage controller 313 is operative to apply development voltage DB to development rollers 43 of ID units 4 placed in stations S1 to S5. Charge voltage controller 314 is operative to apply charge voltage CH to charge rollers 42 of ID units 4 placed in stations S1 to S5. Transfer controller 315 is operative to apply transfer voltage TR1 to primary transfer rollers 71 to 75, and to apply transfer voltage TR2 to secondary transfer roller 25.

Exposure controller 320 is operative to control the exposure operation of light sources 61 to 65.

Motor controller 330 is operative to control operation of the motors in image formation apparatus 1. Thus, motor controller 330 is adapted to rotate each photoreceptor drum 41, drive roller 12, hopping roller 21, registration roller 23, conveyance roller 24, ejection roller 28, and press roller 52. Motor controller 330 is also adapted to rotate separator 27 and separator 32 at certain rotation angels.

As employed herein, ID units 4K, 4Y, 4M, 4C, 4W correspond to one specific example of "development devices" of the invention. ID unit 4W corresponds to one specific example of a "first development device" of the invention. Development roller 43 corresponds to one specific example of a "development unit" of the invention. Supply roller 44 corresponds to one specific example of a "supply unit" of the invention. Toner regulation blade 46 corresponds to one specific example of a "regulation member" of the invention. Photoreceptor drum 41 corresponds to one specific example of an "image carrier" of the invention. Charge roller 42 corresponds to one specific example of a "charging unit" of the invention. High-voltage controller 310 corresponds to one specific example of a "power supply unit" of the invention. Blade voltage controller 311 corresponds to one specific example of a "first power supply" of the invention. Supply voltage controller 312 corresponds to one specific example of a "second power supply" and a "third power supply" of the invention.

(Operation and Function)

Next, a description is given with regard to the operation and function of image formation apparatus 1 according to the embodiment.

(General Outline of Operation)

Firstly, a description is given with reference to FIGS. 1, 2, etc. with regard to a general outline of the operation of image formation apparatus 1. In system controller 200, CPU 210 controls the operation of overall image formation apparatus 1 according to the printing processing program stored in ROM 220, based on print data fed from personal computer PC via host interface 250. When so doing, CPU 210 uses ID unit arrangement table 221 and setting table 222 stored in ROM 220, to control the operation.

Process controller 300 controls the printing process. Specifically, high-voltage controller 310 applies voltages to each ID unit 4, primary transfer rollers 71 to 75, and secondary transfer roller 25, respectively. Exposure controller 320 controls the exposure operation of light sources 61 to 65. Motor controller 330 controls operation of the motors in image formation apparatus 1.

In each of ID units 4, photoreceptor drum 41 carries an electrostatic latent image on the surface (or the surface layer portion). Charge roller 42 charges the surface (or the surface layer portion) of photoreceptor drum 41. Development roller 43 carries toner on the surface. Supply roller 44 supplies the toner stored in toner container 45 to development roller 43. Toner regulation blade 46 forms a toner layer on the surface of development roller 43, and regulates a thickness of the toner layer. Further, toner regulation blade 46 adjusts the amount of electrostatic charge on the toner on the surface of development roller 43. IC tag 48 stores data on the identification number of ID unit 4, the color of the toner in toner container 45, or the like.

(Detailed Operation)

Figure 9:
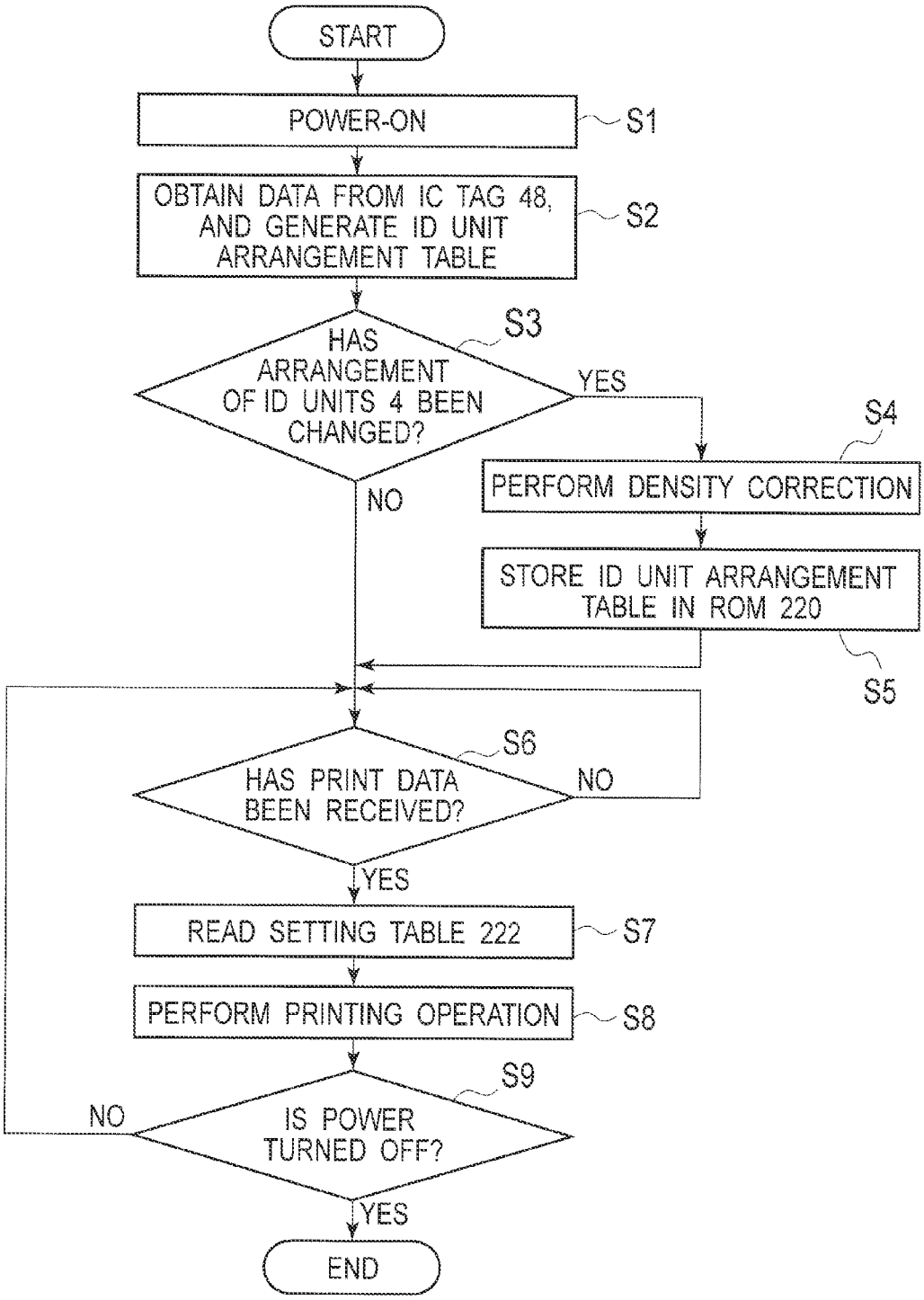
FIG. 9 is a flowchart illustrating one example of the operation of the image formation apparatus illustrated in FIG. 1.

FIG. 9 illustrates one example of an operation of image formation apparatus 1. At power-on, system controller 200 first checks the order of ID units 4 (or the order of the colors) in stations S1 to S5. Then, system controller 200 controls the overall operation of image formation apparatus 1 according to the order of ID units 4. This operation is described in detail below.

When the user powers image formation apparatus 1 on (at step S1), system controller 200 first obtains data stored in IC tag 48 of each ID unit 4 (at step S2). Thus, system controller 200 grasps the color of the toner of each ID unit 4. Then, system controller 200 generates an ID unit arrangement table as illustrated in FIG. 5A or 5B, based on the color of the toner of each ID unit 4.

Then, system controller 200 checks whether or not the arrangement of ID units 4 has been changed (at step S3). Specifically, system controller 200 compares the ID unit arrangement table generated at step S2 with ID unit arrangement table 221 stored in ROM 220, thereby to check whether or not the arrangement of ID units 4 has been changed. If at step S3 a determination is made that the arrangement of ID units 4 has not been changed ("N" at step S3), the operation goes to step S6.

If at step S3 a determination is made that the arrangement of ID units 4 has been changed ("Y" at step S3), image formation apparatus 1 performs a density correction (at step S4). Specifically, system controller 200 first controls process controller 300 thereby to cause each ID unit 4 to form a toner image for the density correction. Thus, the toner image for the density correction is transferred to intermediate transfer belt 11. Then, system controller 200 obtains a detected result of the density of the toner of each color on intermediate transfer belt 11, from density sensor 17. Then, system controller 200 corrects the density of the toner of each color, based on the detected result. System controller 200 performs such operation one or more times thereby to perform the density correction. Then, CPU 210 of system controller 200 updates a density parameter contained in setting table 222 stored in ROM 220, based on the result of the density correction.

Then, system controller 200 writes the ID unit arrangement table generated at step S2, as ID unit arrangement table 221, to ROM 220 (at step S5).

Then, system controller 200 checks whether or not print data has been received via host interface 250 (at step S6). Then, system controller 200 repeats step S6 until the print data is received.

If at step S6 a determination is made that the print data has been received ("Y" at step S6), CPU 210 of system controller 200 reads setting table 222 from ROM 220 (at step S7).

Then, image formation apparatus 1 performs a printing operation (at step S8). Specifically, system controller 200 first controls high-voltage controller 310 of process controller 300, based on setting table 222 read at step S7, so that high-voltage controller 310 applies blade voltage BB to toner regulation blade 46 of each ID unit 4, applies supply voltage SB to supply roller 44 of each ID unit 4, applies development voltage DB to development roller 43 of each ID unit 4, applies charge voltage CH to charge roller 42 of each ID unit 4, applies transfer voltage TR1 to primary transfer rollers 71 to 75, and applies transfer voltage TR2 to secondary transfer roller 25. System controller 200 also controls motor controller 330 of process controller 300 so that motor controller 330 operates the motors. Thus, recording medium 9 is fed and conveyed along conveyance path 20. Then, system controller 200 controls exposure controller 320 of process controller 300 so that photoreceptor drums 41 are exposed to light by light sources 61 to 65, respectively. Thus, toner images are formed by ID units 4, and the toner images are each primarily transferred on the transfer surface of intermediate transfer belt 11, and further, the toner images on intermediate transfer belt 11 are secondarily transferred on the transfer surface of recording medium 9. Then, the toner images transferred to recording medium 9 are fixed by fixation device 50. After that, recording medium 9 is ejected.

Thereafter, while image formation apparatus 1 is in its power-on state ("N" at step S9), image formation apparatus 1 repeats the operation of steps S6 to S8.

(With Regard to Blade Voltage BB and Supply Voltage SB)

Supply roller 44 supplies the toner stored in toner container 45 to development roller 43. Then, toner regulation blade 46 forms a toner layer on the surface of development roller 43, and regulates a thickness of the toner layer. Here, it is desirable that the toner on the surface of development roller 43 be sufficiently negatively charged (or be normally charged) by frictional electrification. However, toner having a high electrical conductivity due to the toner containing a metallic material, such for example as white toner, may be insufficiently negatively charged or be positively charged (or be unnormally charged) due to the fact that electric charge escapes even if an attempt is made to charge the toner. Thus, when the toner on the surface of development roller 43 is insufficiently negatively charged or is positively charged, image quality may deteriorate. This operation is described in detail below by giving several examples of the operation.

Firstly, as Operation Example 1, a description is given with regard to an example in which ID units 4W, 4Y, 4M, 4C, 4K are placed in this order in five stations S5, S4, S3, S2, S1, respectively, as illustrated in FIG. 3B.

Figure 10:
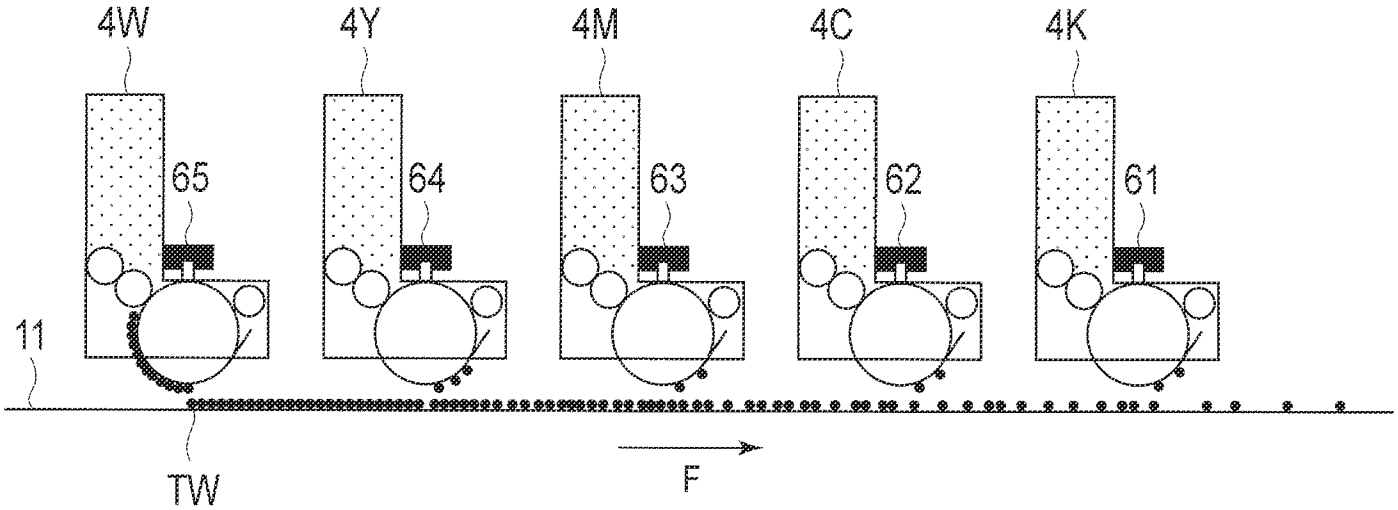
FIG. 10 is a schematic representation illustrating the behavior of toner in the image formation apparatus illustrated in FIG. 1.

FIG. 10 schematically represents the behavior of white toner TW in Operation Example 1. As illustrated in FIG. 10, white toner TW, in this example, is primarily transferred on intermediate transfer belt 11 by ID unit 4W placed in station S5. Then, toner TW on intermediate transfer belt 11 passes sequentially through ID units 4Y, 4M, 4C, 4K arranged downstream of ID unit 4W, as intermediate transfer belt 11 moves in conveyance direction F. Here, positively charged toner or insufficiently negatively charged toner, in white toner TW, is adsorbed on photoreceptor drums 41 in ID units 4Y, 4M, 4C, 4K. In short, photoreceptor drums 41 are negatively charged, and therefore, the positively charged toner or the insufficiently negatively charged toner is adsorbed on photoreceptor drums 41. Thus, white toner TW on intermediate transfer belt 11 decreases each time white toner TW passes through ID units 4Y, 4M, 4C, 4K.

FIG. 11 illustrates blade voltage BB and supply voltage SB in ID unit 4W placed in station S5, and printed image quality in a case of printing performed under such setting conditions. In this example, three parameters (i.e. a gray background level, a stain level, and a white density) are used to evaluate the printed image quality. The gray background level is a parameter indicating the amount of white toner TW transferred to an undesired region on which white toner TW should not be transferred, due to the fact that white toner TW is insufficiently negatively charged. The gray background level is such that its higher value indicates that the toner is more sufficiently negatively charged. In this example, it is desirable that the gray background level be equal to or more than "9." The stain level is a parameter indicating the degree of stain in a so-called white background region having no image, and its higher value indicates less stain. In this example, it is desirable that the stain level be equal to or more than "9." The white density is a parameter indicating the density of white toner TW, and its lower value indicates higher density. In this example, it is desirable that the white density be equal to or less than "0.3."

In this example, blade voltage BB and supply voltage SB in ID unit 4W are both set to −430 [V]. In this case, the gray background level is "9" and the stain level is "9," and they are both good. In other words, in this example, after the passage of white toner TW through ID units 4Y, 4M, 4C, 4K, positively charged toner or insufficiently negatively charged toner decreases, and thus, the gray background level has a good value. However, the amount of white toner TW on intermediate transfer belt 11 decreases, and thus, the white density is "0.35," which is slightly more than its desirable level "0.3."

Next, as Operation Example 2, a description is given with regard to an example in which ID units 4K, 4Y, 4M, 4C, 4W are placed in this order in five stations S5, S4, S3, S2, S1, respectively, as illustrated in FIG. 3A.

Figure 12:
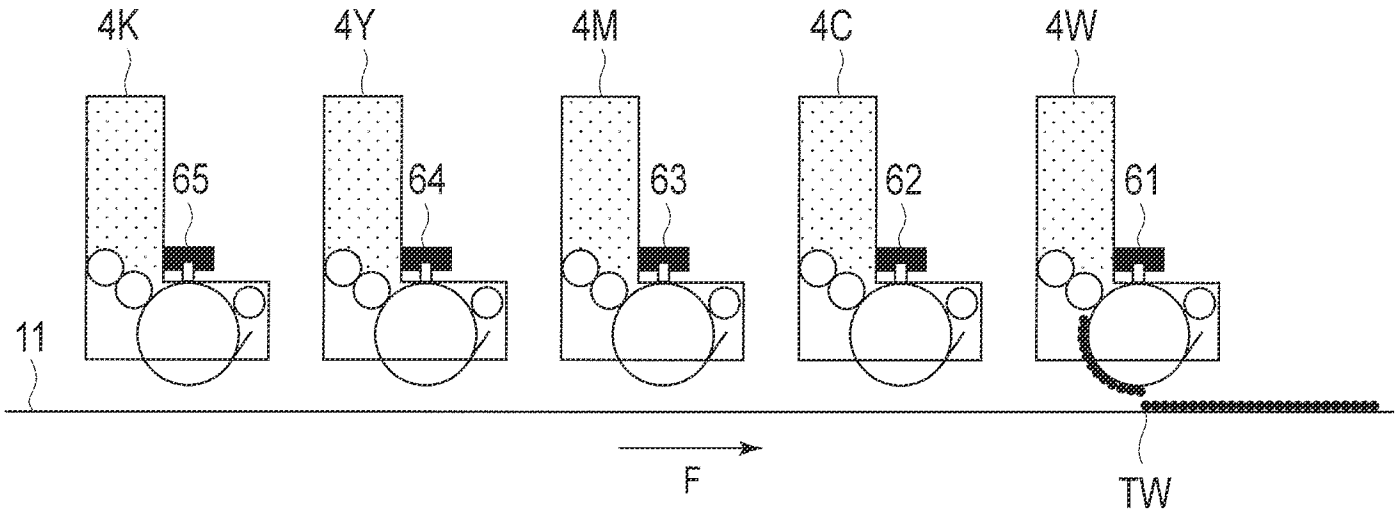
FIG. 12 is another schematic representation illustrating the behavior of the toner in the image formation apparatus illustrated in FIG. 1.

FIG. 12 schematically represents the behavior of white toner TW in Operation Example 2. As illustrated in FIG. 12, white toner TW is primarily transferred on intermediate transfer belt 11 by ID unit 4W placed in station S1. Then, toner TW on intermediate transfer belt 11 moves rearward as intermediate transfer belt 11 moves in conveyance direction F. Here, positively charged toner or insufficiently negatively charged toner, in white toner TW, remains as it is, on intermediate transfer belt 11. In other words, in Operation Example 2, as distinct from the case of Operation Example 1, ID unit 4 is absent downstream of ID unit 4W, and thus, such toner remains as it is, on intermediate transfer belt 11.

FIG. 13 illustrates blade voltage BB and supply voltage SB in ID unit 4W placed in station S1, and printed image quality in a case of printing performed under such setting conditions. In this example, blade voltage BB and supply voltage SB in ID unit 4W are both set to −430 [V]. In this case, the white density is "0.25" and the stain level is "9," and they are both good. In other words, in this example, positively charged toner or insufficiently negatively charged toner remains, as it is, on intermediate transfer belt 11 and does not decrease unlike Operation Example 1, and thus, the white density has a good value. Thus, however, such positively charged toner or insufficiently negatively charged toner remains on intermediate transfer belt 11, and thus, the gray background level is "5," which is less than its desirable level "9."

In image formation apparatus 1, therefore, toner regulation blade 46 adjusts the amount of electrostatic charge on the toner on the surface of development roller 43. Specifically, blade voltage BB of toner regulation blade 46 is set to a negative voltage having a larger value.

Figures 14, 15, 16:
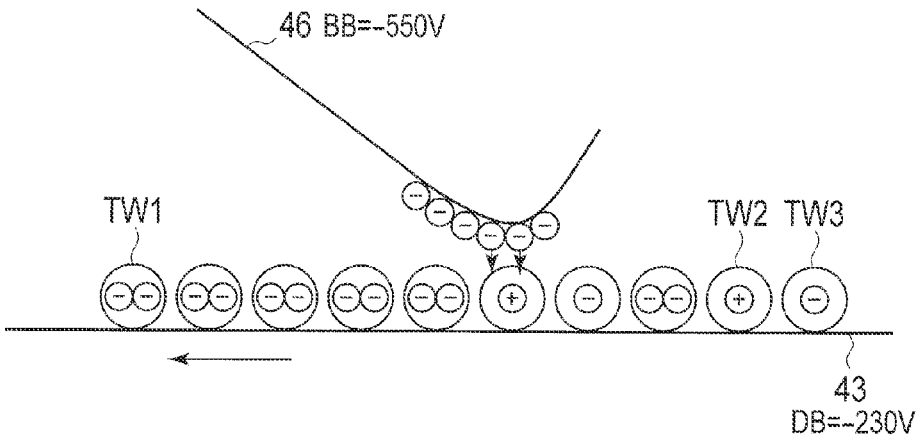
FIG. 14 is still another schematic representation illustrating the behavior of the toner in the image formation apparatus illustrated in FIG. 1.
FIG. 15 is a table illustrating still another example of characteristics of the image formation apparatus illustrated in FIG. 1.
FIG. 16 is a table illustrating a further example of characteristics of the image formation apparatus illustrated in FIG. 1.

FIG. 14 schematically represents the behavior of white toner TW on the surface of development roller 43. In FIG. 14, TW1 indicates sufficiently negatively charged toner, TW2 indicates positively charged toner, and TW3 indicates insufficiently negatively charged toner.

In this example, blade voltage BB is set to −550 [V]. In other words, in this example, blade voltage BB is set to a negative voltage having a larger value (−550 [V]), although in Operation Example 2 blade voltage BB is set to −430 [V] as illustrated in FIG. 13. Thus, positively charged toner TW2 and insufficiently negatively charged toner TW3 on the surface of development roller 43, for example, can be sufficiently negatively charged. Consequently, the amount of positively charged toner TW2 and insufficiently negatively charged toner TW3 on the surface of development roller 43 can be reduced.

Next, as Operation Example 3, a description is given with regard to an example in which blade voltage BB is set to −550 [V] in a case where ID units 4K, 4Y, 4M, 4C, 4W are placed in this order in five stations S5, S4, S3, S2, S1, respectively, as illustrated in FIG. 3A.

FIG. 15 illustrates blade voltage BB and supply voltage SB in ID unit 4W placed in station S1, and printed image quality in the case of printing performed under such setting conditions. In this example, blade voltage BB and supply voltage SB in ID unit 4W are both set to −550 [V]. In this case, the gray background level is "9" and the white density is "0.25," and they are both good. In other words, in this example, blade voltage BB is set low, and thus, the amount of positively charged toner TW2 and insufficiently negatively charged toner TW3 on the surface of development roller 43 decreases, so that the gray background level and the white density have their respective good values. In this example, however, supply voltage SB is also set to −550 [V], and thus, supply roller 44 supplies an excessive amount of toner to development roller 43. Consequently, toner is developed even in a so-called white background region having no image, and thus, the stain level is "5," which is less than its desirable level "9."

Next, as Operation Example 4, a description is given with regard to an example in which blade voltage BB is set to −550 [V] and supply voltage SB is set to −430 [V] in a case where ID units 4K, 4Y, 4M, 4C, 4W are placed in this order in five stations S5, S4, S3, S2, S1, respectively, as illustrated in FIG. 3A. Note that Operation Example 4 corresponds to the settings in FIG. 6A.

FIG. 16 illustrates blade voltage BB and supply voltage SB in ID unit 4W placed in station S1, and printed image quality in the case of printing performed under such setting conditions. In this example, blade voltage BB in ID unit 4W is set to −550 [V], and supply voltage SB is set to −430 [V]. In this case, as is the case with Operation Example 3, the gray background level is "9" and the white density is "0.25," and they are both good. Further, the stain level is "9," which is a good value. In other words, as distinct from the case of Operation Example 3, supply voltage SB is set to −430 [V], and thus, supply roller 44 can supply a proper amount of toner to development roller 43, so that the stain level can be improved.

In image formation apparatus 1, for example, when ID units 4K, 4Y, 4M, 4C, 4W are placed in this order in five stations S5, S4, S3, S2, S1, respectively, as illustrated in FIG. 3A, blade voltage BB in ID unit 4W placed in station S1 is set to −550 [V] and supply voltage SB is set to −430 [V], as illustrated in FIG. 6A. In other words, differential voltage ΔV is set to a positive value (120 [V]). Thus, image formation apparatus 1 can achieve the gray background level, the stain level and the white density all having their respective good values, as illustrated in Operation Example 4 (FIG. 16), thereby enabling an improvement in image quality.

Moreover, for example, when ID units 4W, 4Y, 4M, 4C, 4K are placed in this order in five stations S5, S4, S3, S2, S1, respectively, as illustrated in FIG. 3B, blade voltage BB and supply voltage SB in ID unit 4W placed in station S5 are both set to −430 [V], as illustrated in FIG. 6B. In other words, differential voltage ΔV is set to 0 [V]. Thus, image formation apparatus 1 can achieve the gray background level and the stain level having their respective good values and can also suppress deterioration in the white density, as illustrated in Operation Example 1 (FIG. 11), thereby enabling an improvement in image quality.

In other words, in image formation apparatus 1, as illustrated in FIGS. 6A and 6B, differential voltage ΔV in ID unit 4W when ID unit 4W is placed in station S1 (FIG. 6A) is set greater than differential voltage ΔV in ID unit 4W when ID unit 4W is placed in station S5 (FIG. 6B). Thus, image formation apparatus 1 can improve image quality.

(Advantageous Effect)

According to the embodiment, as described above, differential voltage ΔV when ID unit 4W is placed in station S1 is set greater than differential voltage ΔV when ID unit 4W is placed in station S5, and thus, image quality can be improved.

(Modification 1)

In the above-described embodiment, the white toner is described byway of example; however, the invention is not so limited. In other words, the black toner, the yellow toner, the magenta toner, and the cyan toner, for example, may also be insufficiently negatively charged or be positively charged although there is a difference in extent. Therefore, the invention may be applied to anything other than the white toner. For example when the invention is applied to the black toner, differential voltage ΔV when ID unit 4K is placed in station S1 is set greater than differential voltage ΔV when ID unit 4K is placed in station S5. The same goes for application to other-colored toners.

Also, when a transparent toner (or clear toner), gold toner, silver toner, mica toner, UV toner, or the like, for example, is used, the invention may be applied to such toner. The transparent toner is used for example to partially add luster. The gold toner or the silver toner is used for example to give a glossy luster. The gold toner contains, for example, copper as a colorant, and the silver toner contains, for example, aluminum as a colorant. The mica toner is toner containing a magnetic material. The UV (Ultra Violet) toner is toner which reacts with ultraviolet light. Such toner is somewhat high in electrical conductivity due to it containing a metallic material. Consequently, such toner may be insufficiently negatively charged or be positively charged due to the fact that electric charge escapes even if an attempt is made to charge the toner. When such toner is used, it is therefore desirable that the invention be applied to the toner.

(Modification 2)

In the above-described embodiment, differential voltage ΔV when ID unit 4W associated with the white toner is placed in station S1 is set greater than differential voltage ΔV when ID unit 4W is placed in station S5; however, the invention is not so limited. Instead, for example, differential voltage ΔV when ID unit 4W associated with the white toner is placed in station S1 may be set greater than differential voltage ΔV when ID unit 4W is placed in a station (i.e. at least one of stations S2 to S5) upstream of station S1. Also, for example, differential voltage ΔV when ID unit 4W associated with the white toner is placed in station S2 may be set greater than differential voltage ΔV when ID unit 4W is placed in a station (i.e. at least one of stations S3 to S5) upstream of station S2. Also, for example, differential voltage ΔV when ID unit 4W associated with the white toner is placed in station S3 may be set greater than differential voltage ΔV when ID unit 4W is placed in a station (i.e. at least one of stations S4 and S5) upstream of station S3. Also, for example, differential voltage ΔV when ID unit 4W associated with the white toner is placed in station S4 may be set greater than differential voltage ΔV when ID unit 4W is placed in station S5 upstream of station S4.

(Modification 3)

In the above-described embodiment, a toner image formed by each ID unit 4 is transferred (or primarily transferred) on the transfer surface of intermediate transfer belt 11, and thereafter, the toner image on the transfer surface of intermediate transfer belt 11 is transferred (or secondarily transferred) on the transfer surface of recording medium 9; however, the invention is not so limited. Instead, the toner image formed by each ID unit 4 may be transferred directly on the transfer surface of recording medium 9.

(Modification 4)

In the above-described embodiment, as illustrated in FIGS. 6A and 6B, negative voltages are applied to charge roller 42, development roller 43, supply roller 44, and toner regulation blade 46, respectively; however, the invention is not so limited. Instead, for example, positive voltages may be applied to charge roller 42, development roller 43, supply roller 44, and toner regulation blade 46, respectively. Also in this case, differential voltage ΔV (=|BB|−|SB|=BB−SB) when ID unit 4W is placed in station S1 is set greater than differential voltage ΔV when ID unit 4W is placed in station S5, and thereby, image quality can be improved.

Although the invention is described above with reference to the embodiment and Modifications, it should be understood that the invention is not limited to the embodiment and the like, and various modifications are possible.

For example, in the above-described embodiment and the like, the invention is applied to the printer but is not so limited, and instead, for example, the invention may be applied to a multifunction peripheral having functions such as a printer, a facsimile, and a scanner.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

development devices placed on a one-to-one basis in stations arranged side by side, and configured to sequentially start development in an order according to an arrangement order of the stations in a conveyance direction of a medium, wherein the stations include a first station and a second station, the second station provided upstream of the first station with respect to the conveyance direction; and a power supply unit, wherein each of the development devices comprises a development unit, a supply unit configured to supply a developer to the development unit, and a regulation member configured to regulate an amount of the developer adhering on the development unit, wherein an order of the development devices, in the conveyance direction, is changeable on a one-to-one basis in the stations, and the power supply unit applies voltages to each regulation member and each supply unit, wherein the power supply unit sets a differential voltage of a first development device among the development devices based on the order of the development devices such that the first development device has a greater differential voltage when the first development device is placed in the first station than when the first development device is placed in the second station upstream of the first station, where the differential voltage denotes a voltage obtained by subtracting an absolute value of a voltage of the supply unit from an absolute value of a voltage of the regulation member.

2. The image formation apparatus according to claim 1, wherein the development device placed in the first station starts the development later than any of the development devices placed in the stations other than the first station.

3. The image formation apparatus according to claim 1, wherein the development device placed in the second station starts the development earlier than any of the development devices placed in the stations other than the second station.

4. The image formation apparatus according to claim 1, wherein when the first development device is placed in the first station, the differential voltage is greater than 0 V.

5. The image formation apparatus according to claim 1, wherein when the first development device is placed in the second station, the differential voltage is equal to 0 V.

6. The image formation apparatus according to claim 1, wherein electrical conductivity of the developer of the first development device is higher than electrical conductivity of the developers of the other development devices.

7. The image formation apparatus according to claim 1, wherein a color of the developer of the first development device is a white color.

8. The image formation apparatus according to claim 1, wherein a color of the developer of the first development device is one from the group of a gold, silver and black color.

9. The image formation apparatus according to claim 1, wherein the power supply unit includes a first power supply configured to apply a first voltage to the regulation member of the development device placed in a third station in which the development is last started, among the stations, a second power supply configured to apply a second voltage to the supply unit of the development device placed in the third station, and a third power supply configured to apply a third voltage to the regulation member and the supply unit of the development device placed in a fourth station other than the third station.

10. The image formation apparatus according to claim 1, wherein each of the development devices further includes an image carrier configured to carry an electrostatic latent image, and a charging unit configured to charge the image carrier, and the development unit is configured to cause the developer to adhere to the image carrier, thereby to develop the electrostatic latent image.

11. The image formation apparatus according to claim 1, wherein, when the first development device is placed in a most downstream station of the stations with respect to the conveyance direction, the supply voltage is kept at a same value as when the first development device is placed in any one of the other stations, and wherein an absolute value of a blade voltage is larger when the first development device is placed in the most downstream station than when the first development device is placed in any one of the other stations.

12. The image formation apparatus according to claim 1, wherein the first development device includes titanium oxide as a colorant.

13. The image formation apparatus according to claim 1, wherein the absolute value of the voltage of the supply unit for the first station is greater than respective absolute values of the voltages of the supply units for any of the other stations, and wherein the absolute value of the voltage of the regulation member for the first station is greater than respective absolute values of the regulation members of the supply units for any of the other stations.

14. The image formation apparatus according to claim 1, wherein, in a first case where the first development device is placed in the first station and the first station is a station most downstream of the plurality of stations, the differential voltage for the first development device is greater than 0 V, and wherein, in a second case where the first development device is placed in the second station that is not most downstream of the plurality of stations, the differential voltage for the first development device is equal to 0 V.

15. The image formation apparatus according to claim 14, wherein, in the first case, the differential voltage for the other development devices other than the first development device in stations other than the first station is equal to 0 volts, and wherein, in the second case, the differential voltage for the other development devices other than the first development device in stations other than the second station is equal to 0 volts.

16. The image formation apparatus according to claim 1, wherein the developer of the first development device includes a colorant containing a metallic material.

17. The image formation apparatus according to claim 16, wherein the developer of the first development device includes a colorant that adds luster to a print recording medium, and wherein the greater differential voltage for the first station as compared to stations other than the first station is to counteract effects of electrical conductivity.

* * * * *